United States Patent [19]

Hamid et al.

[11] 4,061,991

[45] Dec. 6, 1977

[54] SEEDED FLAME MICROWAVE POWER LOAD

[75] Inventors: Michael A. Hamid, Winnipeg; Lyall G. Rowlandson, Ottawa, both of Canada

[73] Assignee: Minister of Defense, Canadian Government, Canada

[21] Appl. No.: 650,956

[22] Filed: Jan. 21, 1976

[30] Foreign Application Priority Data

Jan. 28, 1975 Canada ..... 218838

[51] Int. Cl.[2] ..... H01P 1/24

[52] U.S. Cl. ..... 333/22 R; 315/39; 315/111.2; 333/99 PL

[58] Field of Search ..... 333/22 R, 99 PL; 315/111.2, 39; 313/231.3, 231.4

[56] References Cited

U.S. PATENT DOCUMENTS

| | | | |
|---|---|---|---|
| 3,515,932 | 6/1970 | King | 313/231.4 |
| 3,523,210 | 8/1970 | Ernstene et al. | 315/111.2 |

*Primary Examiner*—Paul L. Gensler
*Attorney, Agent, or Firm*—James J. Brown

[57] ABSTRACT

A method and device for absorbing microwave energy avoid the expense and bulk of prior art arrangements, and provide greater efficiency, by forming a flame in the path of the microwave and supplying a seeding substance into the flame to produce a plasma flame column which absorbs the microwave. The seeding substance is preferably an alkali salt solution, e.g. $KNO_3$.

16 Claims, 3 Drawing Figures

SEEDED FLAME MICROWAVE POWER LOAD

The present invention relates to microwave energy absorbing devices.

There exists a need to provide a simple and cheap method for absorbing high microwave energy power levels for absorbing pulsed microwaves, as in radar equipment, or continuous microwaves, as in nuclear power plants and industrial microwave heating processes, in order to protect power generators producing the microwaves.

At present, water loads or specially designed absorbers are employed for absorbing high power microwaves. However, these existing microwave absorbers are expensive, occupy an undesirably large space, and are not always very effective.

It is well known that a plasma arc or column can behave as a dielectric by absorbing electromagnetic waves, depending on the relative values of the transmission frequency of the electromagnetic waves, the plasma frequency and the ion collision frequency of the plasma.

A typical value of a flame plasma frequency is 10 GHz, corresponding to an electron concentration of $10^{12}$ electrons/cm.$^3$, for which absorption of the order of 100 dB/m can be easily achieved.

More particularly the plasma constitutes a cloud of electrons in motion. In the simple case, if an electron is displaced from its original position, an electrostatic field is produced to pull it back. The heavy positive ions constitute a uniform background of positive charge. The mean frequency of oscillation of the electron is defined as the plasma frequency, given by, $$\omega_p = (ne^2/\epsilon_o m)^{\frac{1}{2}} \tag{1}$$

typical values for beams used in microwave tubes being $10^7$ to $10^9$ GHz, and where $n$ = number of electrons per cubic meter
$e$ = charge on electron
$m$ = mass of electron
$\epsilon_o$ = the dielectric constant of vacuum Considering the motion of an electron in a transverse electric field of angular frequency $\omega$, propagating through the plasma and supported by an external source, electron-atom collisions may be considered as the only loss mechanism and the momentum loss rate may be considered to be proportional to the electron velocity and to the collision frequency for momentum transfer $\nu_m$.

From Newton's Second Law, $$m\frac{d\bar{v}}{dt} + m\,\bar{v}\nu_m = eEe_o e^{i(\omega t - \bar{k}.\bar{r})} \tag{2}$$

The solution of Equation (2) is, $$\bar{V} = \frac{-e\,\bar{E}}{m(\nu m + i\omega)} \tag{3}$$

where, $$\bar{E} = E_o e^{i(\omega t - \bar{K}.\bar{r})} \tag{4}$$

Then the current $\bar{J}$ is:

$$\bar{J} = -ne\bar{v} - \sigma\bar{E} = \frac{ne^2\bar{E}}{m(\nu_m + i\omega)} \tag{5}$$

Multiplying the numerator and denominator of Equation (5) by $\epsilon_o$ and simplifying it by use of $\omega_p$ from Equation (1) gives, $$\bar{J} = \sigma\bar{E} = \frac{\omega_p{}^2\epsilon_o}{(\nu_m + i\omega)}\bar{E} \tag{6}$$

From Maxwells equations, $$\nabla \times \bar{H} = \bar{J} + \epsilon_o\bar{E} \tag{7}$$

Substituting (6) and (4) into (7), gives, $$\nabla X\bar{H} = \left(\frac{\omega_p{}^2\epsilon_o}{\nu_m + i\omega} + i\omega\epsilon_o\right)\bar{E} \tag{8}$$

or $$\nabla X\bar{H} - i\omega\epsilon_o\left(1 + \frac{\omega_p{}^2}{i\omega(\nu_m + i\omega)}\right)\bar{E} \tag{9}$$

For an electron gas, the case in question, $$\nu_m/\omega << 1 \tag{10}$$

then, $$\nabla X\bar{H} = i\omega\epsilon_o\left(1 - \frac{\omega_p{}^2}{\omega^2}\right) \tag{11}$$

Obviously when $\omega = \omega_p$ the wave does not propagate through the plasma. Referring to Equation (8) the first term in brackets is the conduction term and the second the displacement term. At $\omega = \omega_p$ this means the displacement current is 180° out of phase with the conduction current, but of equal amplitude and thus cancels.

For $\omega < \omega_p$, the sign of the term in Equation (11) is negative, implying E is 90° out of phase with H. This further implies that the Poynting vector is zero, so no power penetrates the plasma.

For $\omega > \omega_p$, the sign of the term is positive and power is propagated through the plasma.

For the application of microwave energy attenuation by a flame plasma, in order to achieve attenuation $\omega_p$ must be made larger than the radial frequency $\omega$, of the microwave signal.

The high temperature of the flame, in itself, causes the dissociation, that is ionization, of the atoms of the combustible gas mixture. The large number of free electrons produced by this process causes, as shown by Equation (1), a large value for $\omega_p$ in comparison to that found in normal cold plasmas such as the ionosphere.

It has now been found that the plasma frequency can be further raised by the addition of a seeding substance, e.g. $KNO_3$ in solution.

It is an object of the present invention to provide a microwave energy absorbing device which employes a plasma for microwave energy absorbing and which is less expensive and space consuming, and more effective, than prior art microwave energy absorbing devices.

Accordingly, the present invention provides a microwave energy absorbing device comprising means for forming a flame across a waveguide in the path of a microwave signal, and means for supplying a seeding substance to the flame to produce a plasma column for absorption of the microwave signal in the column.

The device may further comprise gas supply means communicating with the interior of the waveguide for providing a flow of combustible gas from one end of the waveguide, and seeding means for supplying a flame plasma seeding material to the gas flow from the waveguide. For example, the gas supply means may comprise a compressed air duct communicating axially with the interior of the waveguide, and at least one further gas duct opening into a wall defining the interior of the waveguide. Also, the gas supply means may comprise a first duct communicating with the interior of the waveguide and the seeding means comprise a second duct communicating with the first duct and valve means for controlling flow of the seeding material through the second duct to the first duct.

Also according to the present invention, there is provided a method of absorbing a microwave signal, which comprises the steps of intercepting a microwave signal by a flame; and introducing into the flame a seeding substance which produces with the flame a plasma flame column for absorption of the microwave signal in the plasma flame column.

The microwave signal may, for example, be intercepted by the exhaust of a jet aircraft or other vehicle, or by a flame thrower or the like provided for that purpose, or the microwave signal may be guided by a waveguide across which the plasma flame column extends, in which case the method may include the step of providing a flow of combustible gas along the interior of the waveguide to the plasma flame column.

The seeding substance preferably comprises an alkali salt, e.g. $KNO_3$, and the plasma flame column preferably has a thickness which is, at least approximately one half of the wavelength of the microwave in the plasma.

The invention will be more readily understood from the following description thereof given, by way of example, with reference to the accompanying drawings, in which.

Figure 1:
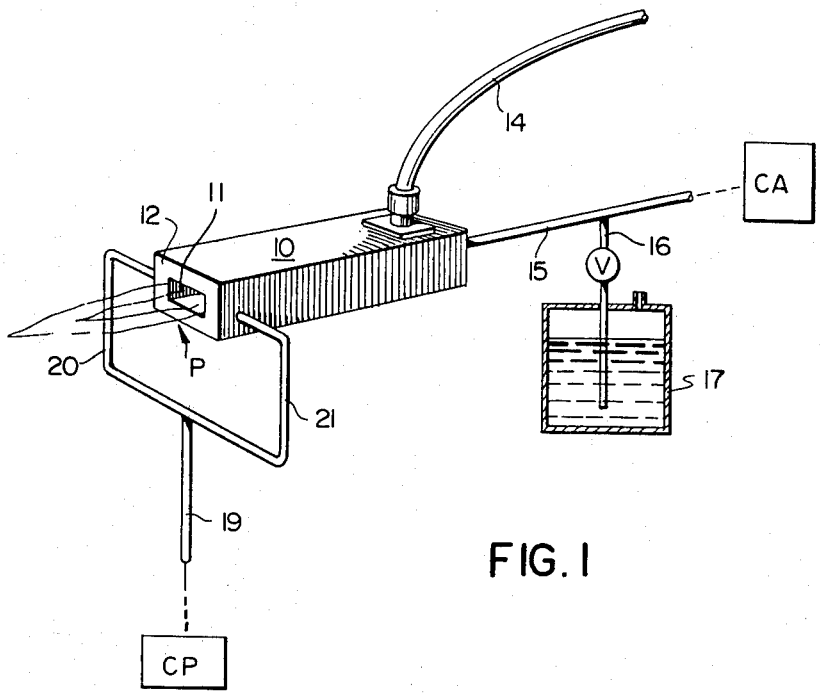
FIG. 1 shows a view in perspective of a microwave energy absorbing device.
Figure 2:
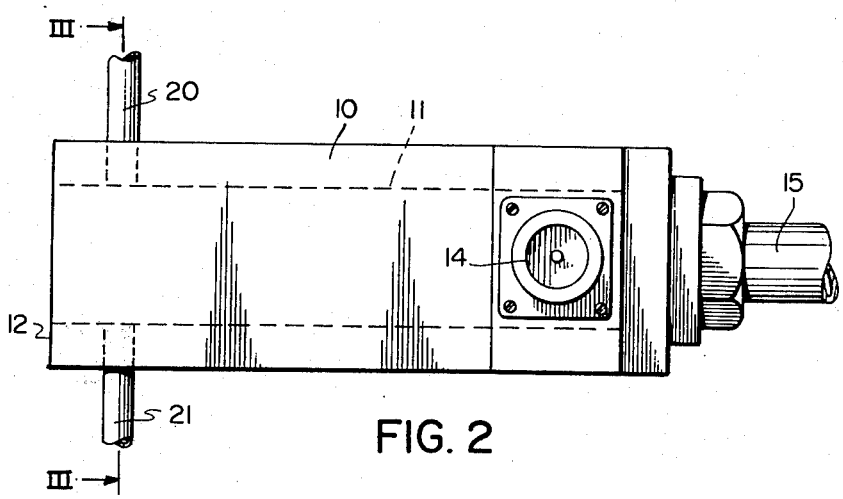
FIG. 2 shows a side view of part of the device of FIG. 1.

The microwave energy absorbing device illustrated in FIG. 1 comprises a main body 10 formed as an open-ended X-band waveguide section and having a passage 11 of rectangular section defining a microwave path and open at one end 12 of the main body 10.

A coaxial line 14 is coupled to the passage 11 for transmission of a microwave signal along the passage 11 and from the end 12 of the main body 10.

A first gas supply pipe or duct 15 communicates with the passage 11 at the opposite end of the main body 10 and serves to supply a flow of air from a compressed air source CA to and along the passage 11.

A second supply pipe or duct 16 communicates with the interior of a container 17, which contains $KNO_3$ in solution, and with the first duct 15.

A control valve V provided in the second duct 16 is operable to control flow of the solution from the container 17 to the first duct 15.

A further gas supply pipe or duct 19 serves to supply the flow of propane from a source CP of compressed propane through branch ducts 20 and 21 into the passage 11 at opposite sides of the passage 11.

Figure 3:
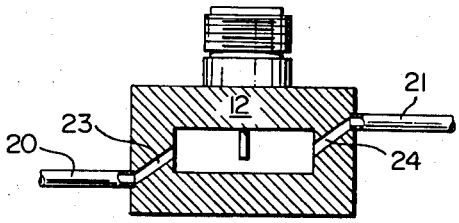
FIG. 3 shows a view taken in section along the line III — III of FIG. 2.

As shown in FIG. 3, the branch ducts 20 and 21 communicate with opposite sides of the passage 11 through lateral passages 23 and 24.

The lateral passages 23 and 24 extend through the wall 25 of the main body and are inclined, in the same direction, so as to cause swirling of the propane on introduction of the propane into the passage 11, and thereby to mix the propane thoroughly with the compressed air flowing along the passage from the first duct 15. Consequently, a combustible gas comprising a mixture of the propane and the air is discharged from the open end of the passage 11 at the end 12 of the main body 10.

In operation of the device, the combustible gas is discharged from the passage 11, as described, and is ignited to form a flame, indicated generally at P, extending across the mouth of the passage 11. The swirling effect caused by the orientation of the passages 23 and 24 makes the flame P more stable in its shape and in its burning properties.

More particularly, the rate of flow of the combustible gas is controlled so that the flame P is positioned just beyond the end 12 of the main body 10, in the direction of flow of the combustible gas, so that the main body 10 does not become heated.

The control valve V is then opened and adjusted so as to allow a flow of the solution from the container 17, through the second duct 16 and into the first duct 15, to be induced by the compressed air flow along the first duct 15. The solution is thus introduced into the flame P to convert it to a plasma flame column.

Microwave energy transmitted from coaxial line 14 along the passage 11 is then absorbed by the plasma flame column P seeded with the $KNO_3$ solution.

More particularly, the flame P provides a source of extremely high thermal energy. When the flame is seeded by introducing $KNO_3$ in solution from the container 17, the thermal energy of the flame is transferred to the atoms of the salt, which places the atoms in an excited state. The atoms dissociate to produce ions. These ions in turn collide, which results in electrons becoming free from their nuclear bonds.

In this way the introduction of the salt into the flame produces a cloud of ions and free electrons, or plasma, which are maintained by the transfer of energy from the flame to the atoms of the salt.

The plasma so formed is a partial electrical conductor because it contains free electrons. The microwave transmitted along the passage 11 from the coaxial line 14 is therefore attenuated as it propagates through the plasma. By adjusting the concentration of the seeding material, it is possible to produce extremely high levels of microwave attenuation. The apparatus therefore provides a means to attenuate and thereby absorb high levels of microwave power.

While $KNO_3$ has been disclosed as the seeding compound employed in the above-described embodiment of the invention, it will be evident to those skilled in the art that other substances may be employed. In his connection, it is noted that the seeding compound employed is preferably a salt of a metal which is easily vapourized and has a relatively low ionization potential. The alkali metals are ideal for this purpose. A table of the alkali metals and their respective ionization potentials is given below:

| METALS | IONIZATION POTENTIAL (eV) |
|---|---|
| Lithium | 5.37 |
| Sodium | 5.12 |
| Potassium | 4.32 |
| Rubidium | 4.16 |
| Caesium | 3.87 |

It is obvious from the table that salts of caesium are the most effective seeding compounds of those listed. In experiments carried out by the inventors, caesium chloride was used in solution strengths of 1 - 5%. Higher concentrations did not prove any more effective and left deposits which disturbed the operation of the burner. However, caesium chloride is a somewhat costly compound. Therefore, in practical devices, potassium salts are preferably used since they are much more economical and almost as effective as the caesium salts in reducing the space charge in the region.

It should also be noted that probes used in the waveguide carrying the signal should have a high melting point in order to withstand the temperature of the flame and should also have a low work function. It was found that either pure tungsten or thoriated tungsten electrodes (0.06 inches in diameter) were excellent for this purpose (e.g. coaxial to waveguide transitions).

Also, while other methods of introducing the seeding compound to the electrothermal region could be employed, it has been found that dissolving the seeding compound in water and aspirating the resulting solution as a mist by the use of compressed air, the mist being directed to the burner and mixed with the air entering the burner ports provides good seeding efficiency. The presence of water vapour in the fuel gases results in a slight lowering of the operating temperature.

Since alkali metal salt solutions are corrosive, the apparatus is preferably made of corrosion-resistance materials such as copper, brass and plastic.

As will be appreciated, various types of loads have been employed hitherto for absorbing microwave power, and all of these prior art loads, with the possible exception of water loads, have undesirable restrictions on the maximum power which can be absorbed. In the case of the present invention, however, the plasma flame column is so hot that the addition of large amounts of power thereto should have a negligible effect and in fact enhances the characteristics of the plasma by creating more heat.

We claim:

1. A microwave energy absorbing device, comprising:
   a wave guide for guiding a microwave signal;
   means for forming a flame across said wave guide; and
   means for supplying a seeding substance to said flame to produce a plasma flame column for absorption of said microwave signal in said column.

2. A microwave energy absorbing device as claimed in claim 1, and further comprising gas supply means communicating with the interior of said waveguide for providing a flow of combustible gas from one end of said waveguide, said means for supplying a seeding material communicating with said gas supply means for supplying the seeding material into said gas flow.

3. A microwave energy absorbing device as claimed in claim 2, wherein said gas supply means comprise a compressed air duct communicating axially with the interior of said waveguide, and at least one further gas duct opening into a wall defining the interior of said waveguide.

4. A microwave energy absorbing device as claimed in claim 3, wherein said gas supply means comprise a first duct communicating with the interior of said waveguide and said means for supplying a seeding substance comprise a second duct communicating with said first duct and valve means for controlling flow of the seeding meaterial through said second duct to said first duct.

5. A method of absorbing microwave energy, which comprises the steps of:
   intercepting a microwave signal by a flame and
   introducing into the flame a seeding substance which produces with the flame a plasma flame column for absorption of the microwave signal in the plasma flame column.

6. A method as claimed in claim 5, which includes employing said seeding substance in liquid form.

7. A method as claimed in claim 5, which includes producing a flow of combustible gas, igniting the gas flow to produce the flame and introducing said seeding substance into said gas flow.

8. A method as claimed in claim 7, which includes producing said gas flow along a waveguide and introducing said microwave signal into said waveguide.

9. A method as claimed in claim 5, wherein said seeding substance is an alkali salt.

10. A method as claimed in claim 6, wherein the seeding substance is an alkali salt.

11. A method as claimed in claim 7, wherein said seeding substance is an alkali salt.

12. A method as claimed in claim 8, wherein said seeding substance is an alkali salt.

13. A method as claimed in claim 5, wherein said seeding substance is $KNO_3$.

14. A method as claimed in claim 6, wherein said seeding substance is $KNO_3$.

15. A method as claimed in claim 7, wherein said seeding substance is $KNO_3$.

16. A method as claimed in claim 8, wherein said seeding substance is $KNO_3$.

* * * * *